United States Patent [19]

Durocher et al.

[11] Patent Number: 4,779,631

[45] Date of Patent: Oct. 25, 1988

[54] WRAPPERS FOR SPECIALTY SMOKING DEVICES

[75] Inventors: Donald F. Durocher, Roswell; Carmen P. DiGrigoli, Canton; Loyd G. Kasbo, Norcross; Edward P. Bullwinkel, Roswell, all of Ga.

[73] Assignee: Kimberly-Clark Corporation, Neenah, Wis.

[21] Appl. No.: 22,860

[22] Filed: Mar. 6, 1987

[51] Int. Cl.[4] ..... A24D 1/02

[52] U.S. Cl. ..... 131/365; 131/336

[58] Field of Search ..... 131/336, 365, 331

[56] References Cited

U.S. PATENT DOCUMENTS

| | | | |
|---|---|---|---|
| 3,049,449 | 7/1962 | Allegrini | 131/365 |
| 4,433,697 | 2/1984 | Owens | 131/365 |
| 4,461,311 | 7/1984 | Mathews et al. | 131/365 |
| 4,561,454 | 12/1985 | Guess | 131/365 |

FOREIGN PATENT DOCUMENTS 0174645 3/1986 European Pat. Off. .

*Primary Examiner*—V. Millin

*Attorney, Agent, or Firm*—William D. Herrick

[57] ABSTRACT

A wrapper particularly useful for smoking articles of the type containing a burn fuel element and ceramic jacket. The wrapper includes an inner layer for surrounding the burn fuel element and jacket and an outer layer with the combination imparting controlled throttling properties. The inner layer may be a conventional cigarette wrapper material of cellulosic construction and having biased burned properties. The outer layer surrounds the inner sheet and preferably comprises cellulose fibers, titanium dioxide, attapulgite clay, high temperature resistant microfibers, and a burn enhancer. The outer wrapper also maintains permeability and pressure drop properties at temperatures in excess of 400° C. while the inner wrapper burns out resulting in generally infinite permeability after burning. The combination in use possesses sufficient mechanical strength to support the assembly of components in specialty smoking articles and as burned properties that produce an ash appearance similar to conventional cigarette ash and has a high degree of ash integrity.

11 Claims, 5 Drawing Sheets

WRAPPERS FOR SPECIALTY SMOKING DEVICES

BACKGROUND OF THE INVENTION

1. Field of the Invention

The present invention relates generally to wrapper materials for smoking articles. In particular the wrappers of the present invention are especially useful in conjunction with smoking articles that include a fuel element rather than conventional cigarettes containing a tobacco rod that is wrapped and burned. Such smoking articles are described, for example, in published European patent application No. 85111467.8 assigned to R. J. Reynolds. Although this European published application describes the use of conventional cigarette papers as wrappers, the requirements for such smoking articles are such that it would be advantageous to include a wrapper that will provide sufficient strength to maintain the assembly of components and that provides burn properties and appearance similar to those of conventional cigarettes. Since such articles do not burn tobacco rods in the conventional sense, it is also very desirable that the wrapper have good burn integrity to maintain the ash of the smoking article.

2. Description of the Prior Art

One description of a smoking article containing a burn fuel element is contained in the above-identified European patent application No. 85111467.8. However, this description refers only to the use of conventional cigarette papers as wrappers, and in use such conventional materials tend to lack adequate strength to maintain the assembly of components and lack the desirable burn properties such as appearance and ash integrity needed to provide optimum performance of the smoking article. It is also known to use finely divided clays such as attapulgite clay in tobacco smoking compositions as described, for example, in U.S. Pat. No. 3,049,449 to Allegrini dated Aug. 14, 1962. Furthermore, the use of high temperature resistant fibers in smoking article wrappers has been described, for example, in U.S. Pat. No. 4,433,697 to Cline and Owens dated Feb. 28, 1984. Burn enhancers such as alkali metal salts are, moreover, known for use in smoking article wrappers as described in U.S. Pat. No. 4,461,311 to Mathews, DeLucia, and Mattina dated July 24, 1984. Finally, smoking articles having double wrapped constructions are described in a number of patents, many of which are listed in U.S. Pat. No. 4,561,454 to Guess dated Dec. 31, 1985 which, itself, relates to a double wrapped smoking article.

In spite of such teachings it remains desired to improve the properties of specialty smoking articles having a fuel element to provide better appearance, integrity of the individual components, and improved burn properties.

SUMMARY OF THE INVENTION

The present invention relates to wrappers for special smoking articles, such as those described in European patent application No. 85111467.8. Such smoking articles include an assembly of components one of which is a fuel element. The assembly is maintained at least in part by the wrapper which, desirably, burns in cooperation with the fuel element to provide an ash similar in appearance to that of conventional cigarettes. The wrapper of the present invention is of dual sheet construction with an inner cellulosic sheet enclosing the fuel element and having a controlled permeability and biased burn properties. The other sheet is an outer wrap that surrounds the inner wrap and comprises cellulosic fibers, high temperature resistant microfibers, and a finely divided clay as well as, preferably, a burn enhancer and titanium dioxide. The outer wrapper with such constituents has a controlled permeability over a wide temperature range, good integrity after burning and also has biased burn properties. This combination of wrappers, particularly in use for such special smoking article constructions provides advantages of high strength and integrity while, at the same time, imparting burn properties similar to those of conventional cigarettes.

DESCRIPTION OF THE PREFERRED EMBODIMENTS

Figure 1:
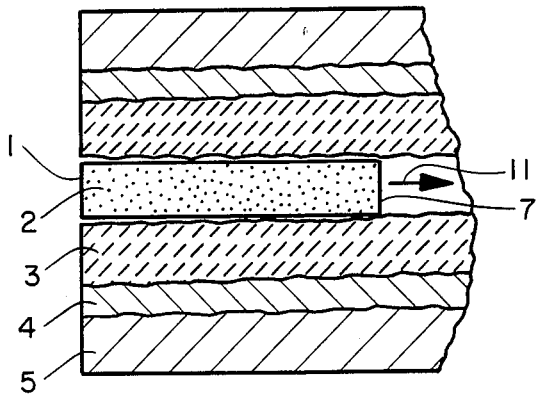
FIG. 1 is an enlarged cross-sectional partial view of the burn end of a specialty smoking article incorporating the dual wrapper construction of the present invention.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

Characterization of the wrapper materials of the present invention may be carried out by evaluating certain critical parameters. The inner sheet, for most purposes, may be a conventional cigarette paper. Such papers, generally, contain predominantly cellulose fibers and may include fillers such as calcium carbonate and clay and one or more additives to enhance burn properties, appearance or the like. For purposes of the present invention, the inner sheet must have a biased burn properties. By "biased burn properties" is meant that the wrapper in combination with the outer wrapper will only free burn when the underlying ceramic fiber jacket is held appreciably above room temperature by heat transfer from the burning fuel element. In general, this biasing may be achieved by providing a low permeability inner sheet, in the range generally of 3 to 30 CORESTA, preferably 5 to 15 CORESTA and adjusting the biased temperature for free burning by varying the amount of burn additive incorporated in the outer sheet material. Alternatively this biased burning may be achieved by adding a portion of the burn additive to both the inner and outer wrapper compositions with the total for both compositions in the range of 3 to 10 percent by weight. This construction will permit rapid burnback of the inner wrapper which will ash quickly in the first 1 to 3 puffs to a point where the heat from the fuel element is insufficient to cause burnback to continue, beyond the first 5 to 9 millimeters on the lit end. From that time on, the paper does not burn during completion of the smoke, usually, about 15 additional puffs.

The outer sheet material for the wrapper of the present invention is of more critical composition and comprises about 40 to 80 percent, preferably 65 to 75 percent cellulose fibers by weight. These cellulose fibers are preferably wood pulp but may comprise flax or other natural cellulose fibers. The outer sheet also contains about 10 to 30 percent, preferably 15 to 25 percent by weight of high temperature resistant microfibers. Such microfibers will preferably have a diameter generally in the range of from about 0.7 to 5.0 microns and will be able to withstand temperatures in excess of 700° C. while maintaining significant strength properties. The outer wrapper composition will also contain a mineral filler in the range of from about 10 to 30 percent by weight including 5 to 15 percent attapulgite clay and up to 10 percent titanium dioxide. The preferred filler is attapulgite clay, but other fillers such as fumed alumina may be used as well. The composition will also preferably contain a burn enhancer in the range of from about 0 to 10 percent by weight, more preferably 5 to 8 percent, depending on factors such as the permeability and density of the combination of wrappers. Such burn enhancers include alkali metal salts such as sodium or potassium citrate but may include other known burn enhancers that act to modify the burn properties of the resulting sheet. Preferably the outer sheet will also contain titanium dioxide in an amount in the range of from about 2 to 8 percent by weight, more preferably about 4 to 6 percent by weight to improve the ash appearance. Within these constraints the outer wrapper material will be formed so as to have a characteristic pressure drop v. temperature curve showing continued pressure drop at temperatures in excess of 400° C. even on successive burns. Also the sheet will show constant permeability at temperatures in excess of 400° C. of less than 3 Z units (as hereinafter defined). Finally, the outer wrapper will have a pressure drop in inches of water in excess of 0.2 at temperatures above 350° C.

Figure 2:
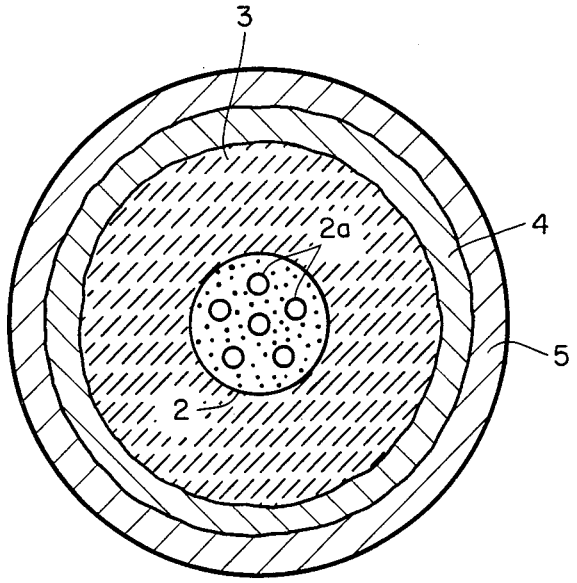
FIG. 2 is an enlarged end view of the smoking article of FIG. 1 showing just the burn end prior to ignition.
Figure 3:
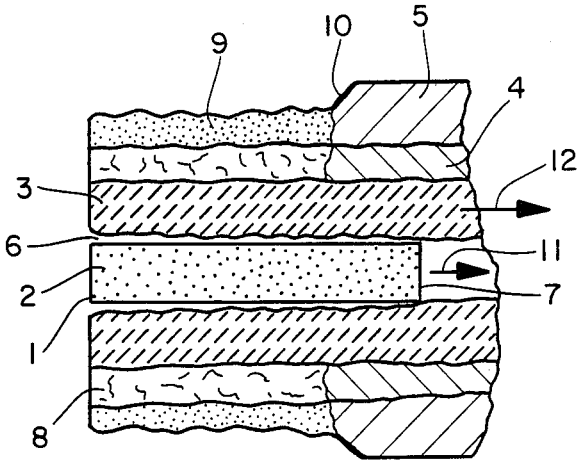
FIG. 3 is an illustration similar to that of FIG. 1 shortly after lighting the smoking article.

Referring to FIG. 1, an unlit version of a smoking article of the type described above with the wrapper combination of the present invention is shown. Here the characteristic carbon fuel source 2 and its surrounding ceramic fiber jacket 3 are shown overwrapped by an inner wrapper 4 and an outer wrapper 5. FIG. 2 is an end view of the article of FIG. 1, no longer in section and illustrates longitudinal pores 2*a* in fuel element 2 which aid in supplying air to fuel element 2 during its combustion. (In the drawings, the thickness of the wrappers has been grossly exaggerated for clarity—in actuality, they are, for example, only 2–3 mils in thickness). In FIG. 3 is shown a freshly lighted version of the same article, i.e., shortly after the article has been lit at the end and puffed 2 or 3 times so that the fuel source 2 is now glowing and at a uniform temperature of some 800°–900° C.

While ceramic fiber jacket 3 remains largely unchanged except for some shrinkage 6 adjacent to fuel element 2, both the inner wrapper 4 and outer wrapper 5 have burned back to or slightly beyond the right hand limit 7 of fuel element 2 and have extinguished. The burnt-out region 8 of inner wrapper 4 has been transformed to essentially inorganic ash, which is highly porous; the corresponding region of outer wrapper 5 has been transformed into a strong, coherent gray-white ash 9, which serves to contain and obscure not only the loose ash of region 8 but any debris from the ceramic fiber jacket 3. Ash 9 is preferably of such strength and coherence that it resists dislodgment when the smoking article is vigorously tapped or struck against an ash tray—thus avoiding the familiar untidiness associated with conventional burning cigarettes. Visually, ash 9 closely resembles the ash appearance of a typical cigarette, which is a desirable esthetic quality. (This is abetted by the presence of a characteristic char line 10 between ash 9 and uncombusted outer wrapper 5.) In addition, ash 9 exhibits controlled permeability that is different from the ash obtained from conventional cigarette wrappers. This property provides "throttling" to the combustion rate of fuel element 2 as the smoking article is puffed from initial lighting (FIG. 3) to exhaustion of said element. In preferred embodiments, the wrapper combination, after burn out, is such that each puff yields hot combustion gases 11 of equal enthalpy so that the subsequent aerosol generation and delivery remain constant from puff-to-puff. Unfortunately, such equal enthalpy puffs are undesirable with the beginning puffs since their heat content will be largely expended in bringing the various parts of the smoking article from a "cold" state to some elevated steady state temperature. If not corrected, this will cause the initial puffs to be quite deficient in aerosol content which will be perceived by the smoker as a negative attribute.

In accordance with the invention, this deficiency is overcome by forcing the fuel element to deliver much higher enthalpy gases during the initial puffs. How this is accomplished with the wrapper combination of the invention can best be understood by considering FIGS. 1–4 which illustrate the various gas flows through the smoking article during puffing (either lit or unlit). By means of various filter configurations (not shown) mounted at the mouth end of the smoking article, the total outflow of gases during a puff may be apportioned between axial gases (pathway 11) and coaxial gases (pathway 12) as mediated by the various upstream resistances.

On lighting the article and first puffing, the principal air flow will be via path 14 (through the pores 2*a* shown in FIG. 2) which rapidly kindles the fuel element 2 to a very high temperature of some 800°–900° C. Air flow 14 is abetted in this kindling by minority air flow 14*a* (FIG. 4) which serves to ignite the complete outer surface of fuel element 2. There is essentially no dilution air via paths 13 since the relatively impermeable wrapper 5 has not yet burnt out. Thus by the second or third puff, the desired high enthalpy gases are being delivered to the downstream elements via path 11. This is however, only a transient condition since the wrappers, particularly outer wrapper 5 will soon "burn out" completely to yield structures of very high permeability. Because of this, large amounts of dilution air will be supplied to the article via pathways 13 with the result that the enthalpy of the hot gases issuing from the fuel element via 11 will be automatically reduced to the desired lower levels in subsequent puffs.

As will be apparent to those skilled in this art, the time of this transition from no dilution to dilution depends on heat transfer properties of the ceramic fiber jacket 3 and what temperatures must be achieved at an outer wrapper 5 to "switch" this wrapper from a relatively impermeable structure to a highly permeable structure. This temperature clearly distinguishes wrappers of the invention from other papers such as conventional cigarette paper. Commercial papers make this permeability transition at approximately 350° C. while wrappers of the invention require temperatures in excess of 500° C. Moreover, wrappers of the invention after burn out do not exhibit the typical "infinite" permeability of ordinary papers but instead, exhibit finite and relatively constant permeability up to 650° C. It is this elevated transition temperature and constant "burnt out" permeability properties of wrappers of the invention that allow the desired equal puff deliveries or "throttling" properties discussed above.

It is further preferred that this low ash permeability be achieved in the outer wrapper alone. That is, the ash (if any) of the inner wrapper should not offer any measurable resistance to the flow of air when compared to that of the outer wrapper ash.

Both wrappers preferably extinguish shortly after the smoking article is lighted and should preferably "go out" after the first 3 or 4 puffs to yield the ash appearance of a newly lit cigarette (5–8 mm in length). This property may be called biased burning, i.e., both wrappers will only free burn when the underlying ceramic fiber jacket is biased appreciably above room temperature by heat transfer from the adjacent burning fuel element. In accordance with the invention, this biasing is achieved by first providing a low permeability wrapper (CORESTA permeability of 3–20 and preferably about 6) and adjusting the bias temperature required for free burning by varying the amount of potassium citrate incorporated in the wrapper.

Figure 4:
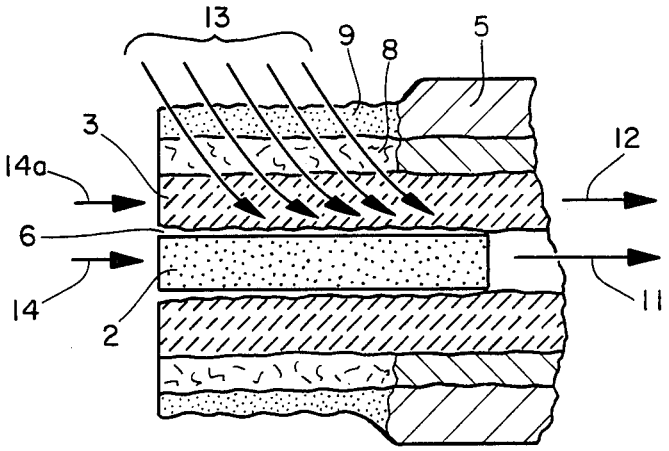
FIG. 4 is an illustration like FIG. 3 showing air flow after combustion of the inner and outer wrappers.

During the brief combustion of the cellulose components comprising the inner and outer wrappers, it is possible to introduce a small fraction of the products of this combustion into path 12 (FIG. 4). These products may be detected by a discerning smoker as contributing certain "burning paper" flavor notes when the smoking article is first puffed. We have found that these possibly objectionable flavor notes can be ameliorated by incorporating small quantities of well-known flavorants (e.g, menthol, vanillin) into the wrappers of this invention.

Alternatively, it is also possible to modify the combustion process to yield less acrid smoke by incorporating a few percent (for example, 1 to 2% by weight based on the total wrapper) of certain reagents. These reagents include known wrapper additives of two classes. The first includes solid oxidizers such as potassium nitrate or potassium chlorate, and the other includes low melting, nonvolatile Lewis acids, such as monoammonium phosphate, polymeric phosphoric acids $(HPO_3)_x$, and their ammonium salts. The second class modifies the odor from high acridity to a pleasant, sweet odor often associated with burning simple sugars. One possible mechanism is the rapid depolymerization of cellulose to glucose and glucosans during the initial heating of the wrapper.

In summary, the components of the wrapper combination of the invention have the properties listed below:

A. Inner Wrapper

1. Sufficient mechanical strength to serve as an adjunct in the assembling of sub-components of the smoking article at speeds comparable to conventional cigarette making.

2. Burns out to leave a residue or ash which exhibits essentially "infinite" air permeability when compared to its companion outer wrap.

3. Exhibits "biased" burning, i.e., will not free burn (smolder) when the underlying substrate is at or near room temperature.

B. Outer Wrapper

1. In appearance resembles conventional cigarette paper.

2. Sufficient mechanical strength to permit defect-free production of the smoking articles at speeds comparable to conventional cigarette manufacturing.

3. Burns out to yield an ash that not only resembles that from a conventional cigarette (grayish-white), but provides also relatively low air permeability.

4. Must exhibit "biased" burning characteristics as described in A, 3 above.

5. Produces a strong, coherent ash.

While the inner wrapper requirements can be met with conventional cigarette papers (providing the burn chemical level and porosity levels are carefully adjusted to achieve "biased burning"), the unique and conflicting requirements cited above for the outer wrapper in accordance with the invention are met by a new paper composition with components that interact in new and unexpected ways to meet these requirements.

The preferred outer wrapper composition is:

| | |
|---|---|
| Basis Weight | Preferably 35 to 45 gsm, with about 40 gsm most preferred |
| Percent hydrated bleached kraft pulp | 40–80% |
| Glass fiber | 10–30% |
| Mineral filler | 10–30% (preferably composed of 5–15% attapulgite clay and 0–10% titanium dioxide) |
| Potassium citrate | 3–10% |

The attapulgite clay of choice is Attagel 40 from Englehart Industries. The glass fiber is preferably a microglass, e.g., Evans 606.

Preferably, the glass/clay components should be in ratio of about 2:1 to maintain optimum ash integrity. If glass is omitted, the ash is flaky; while if the glass content is increased, the ash shrinks too much and is, as a consequence, unappealing in appearance. Other conventional clays (kaolinite, Ansilex TM) fail in any proportion with or without glass to meet the requirement for ash integrity and permeability cited above. Unexpectedly, the $TiO_2$ does not function as a typical opacifying pigment, but instead serves in an unknown chemical fashion to provide the desired light gray ash color. When it is omitted, the ash is black and unappealing. If such black ashes are subsequently mixed with the corresponding amount of lacking $TiO_2$, the resultant gray color is noticeably darker than that observed when $TiO_2$ is present initially. This result suggests the unexpected chemical mentioned above.

In accordance with the invention it has further been found that the requisite mechanical strength of the outer wrapper ash may be achieved by substituting other glass-like fibers for glass microfibers. Of particular interest here is phosphate glass fiber material, calcium sodium metaphosphate, such as that manufactured by the Monsanto Co., St. Louis, Mo. Because of its high melting point of 740° C., the stable permeability of ashes incorporating this fiber will be extended to this temperature range.

The potassium citrate is required for the "biased burning" and also contributes to the resultant ash strength. The final ash (after burning off the cellulose portion) can be also low as 20% by weight of the initial paper weight without seriously impinging on the coherence, strength and permeabilitty requirements.

Figure 5:
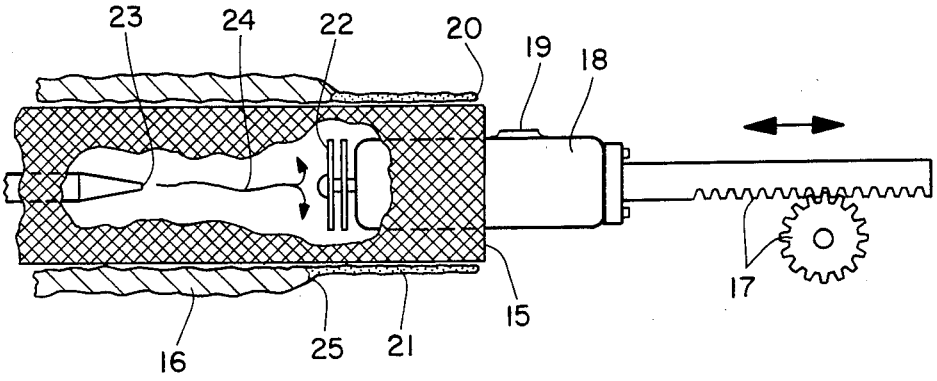
FIG. 5 is an illustration of a device used to measure burn properties of outer wrappers in accordance with the invention.
Figure 6:
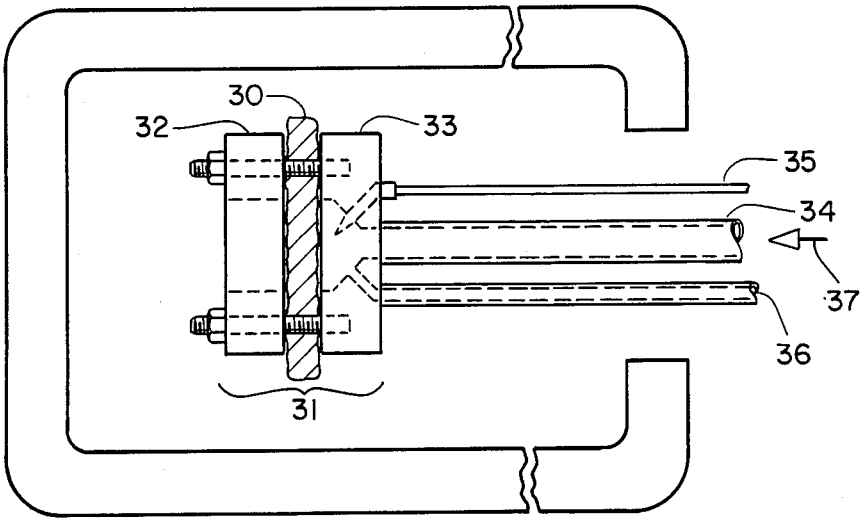
FIG. 6 is an illustration of a permeability tester used to determine permeability of the wrapper materials of the present invention.

To demonstrate properties of the wrapper combination of the present invention, the test apparatus shown in FIGS. 5 and 6 have been found to be useful.

The apparatus shown in FIG. 5 may be termed an "Ash Characterization Device" and comprises a stationary cylindrical tube 15 of stainless steel screen, some 15 mm in diameter, which forms a support and substrate for a pre-formed cylinder of wrapper 16 to be tested. (The wrapper sample may be either the combination of inner and outer wrappers or the individual wrappers themselves. For simplicity, the description assumes that 16 is the outer wrapper alone.)

Following installation of pre-formed wrapper cylinder 16 on tube 15, drive mechanism 17 is activated which causes the cylindrical electrical heater 18 to advance at a controlled rate (10–40 mm/min.) into the interior of tube 15. Heater 18, pre-heated to a set surface temperature (in the range of 850°–900° C.) as controlled by the attached thermocouple 19 rapidly and progressively decomposes the wrapper sample on enteringg tube 15. At this stage, the sample is ignited with an external electric lighter (not shown) to initiate a smoldering burn at end 20 on the wrapper sample. Heater 18 is of lesser diameter than tube 15 and only heats tube 15 by convection and radiation. As a consequence, a considerable length of heater 18 must be inserted into 15 before the included parts of 15 reach the high temperature necessary to insure complete "burn-out" of the wrapper 16 as indicated by the presence of ash 21. To overcome the abnormal heat transfer of stainless steel compared to the ceramic or other heat resistant fiber substrate of the smoking article, heater 18 is equipped with radiation shields 22. Additionally, cooling air 24 is introduced by stationary jet 23. This air stream and shields 22 serve to maintain the unexposed wrapper sample 16 at essentially room temperature. As a consequence of the high temperature gradient so generated, a sharp char line 25 of reasonable width is produced. In using the apparatus of FIG. 5, one first observes visually the dynamic burning of the wrapper as the heater 18 advances steadily into tube 15 and afterwards quickly retracts heater 18 by reversing feed mechanism 17. At this step, wrappers with the proper "bias burning" characteristics will cease glowing in the char region and rapidly extinguish, i.e., no "burn-back" will occur. Following this part of the test, one can next visually record ash appearance and then de-mount tube 15 carrying the sample wrapper and its ash) from the apparatus shown in FIG. 5. When so de-mounted, tube 15 can serve as a support for carrying out simple mechanical strength tests on the generated ash 21. These might be as simple as "knocking" tube 15 on the edge of an ash tray and observing whether or not ash 21 is dislodged or disintegrated by this action. (In general, the outer wrappers of this invention survive this severe test.)

Figure 9:
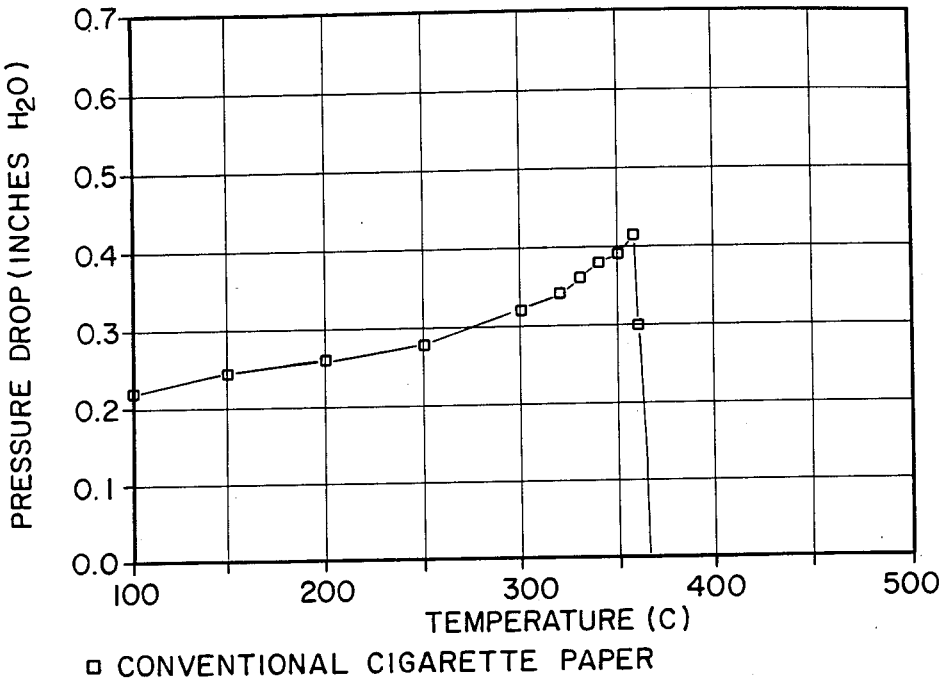
FIG. 9 is a graph illustrating conventional cigarette paper in terms of pressure drop as a function of temperature.
Figure 10:
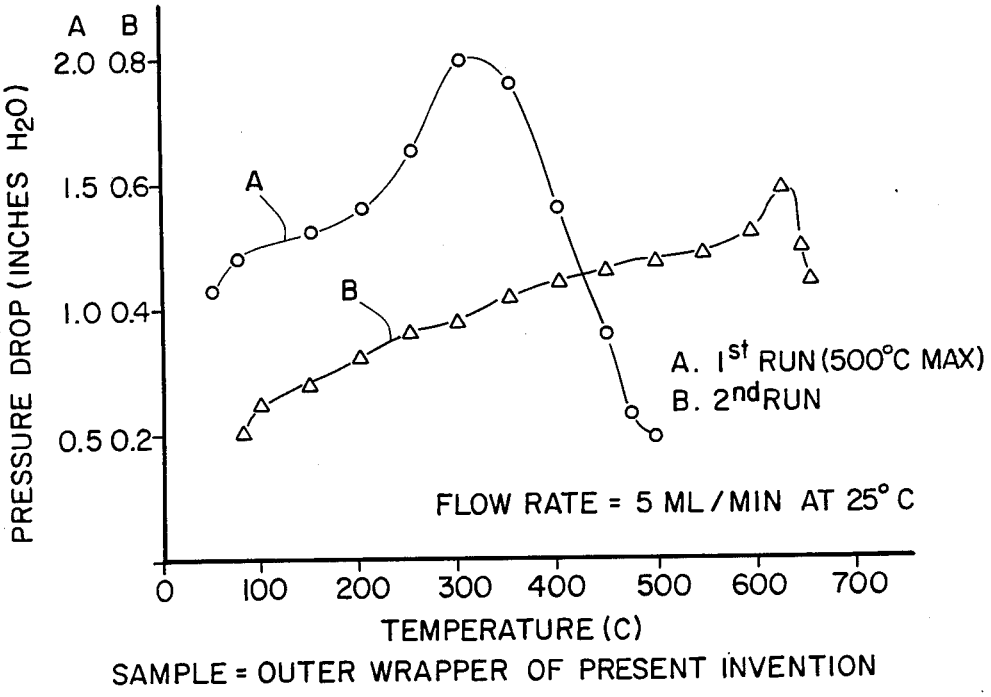
FIG. 10 is a graph like that of FIG. 9 for an outer wrap embodiment of the present invention before and after burn-out.

The apparatus in FIG. 6 is designed to measure the permeability of wrappers as a function of temperature. As shown, a wrapper sample 30 is clamped in holder 31; one member 32 is open to the atmosphere, while the other member 33 is connected to a constant flowrate supply of air 37 supplied via tube 34. Member 33 also carries thermocouple assembly 35 to measure air temperatures adjacent to sample 30 and pressure tap 36 to measure the pressure drop across sample 30 in response to constant flow 37. Each of these are connected via appropriate electrical transducers to an x–y recorder so that a plot of pressure drop vs. temperature is obtained when surrounding electric furnace 38 is heated from room temperature to some desired high temperature. Typical plots for conventional cigarette paper and the outer wrapper of the present invention are shown in FIGS. 9 and 10, respectively. (In these figures, the test sample diameter was $\frac{3}{8}''$ and the constant air flowrate was set at 5.0 ml/min at 25° C.). FIG. 10 is a double plot showing the behavior of the outer wrapper on a first temperature cycle to 500° C. (Curve A) and a re-run of the same sample after cooling to room temperature (Curve B). This protocol was used to avoid the spurious pressure drop peaks observed during decomposition of the cellulose fiber content (cf. maximum at 350° C., Curve A). These peaks are caused by the evolution of gases generated in this decomposition which momentarily over-pressurize the chamber of clamp member 33. (These peaks are never seen with conventional filled sheets such as cigarette paper since they rupture at this stage.) In essence, Curve B is the ash behavior of ash generated at 500° C. The characteristic steep pressure drop decrease at 650° C. is caused by the fusion of the glass microfibers which causes the ash to reticulate into a more open structure.

To remove the confounding increase in viscosity and decrease in density of air with temperature, these raw data have been coverted to permeability units using the reasonable OHM's law analogy that the permeability of the sample 7 should be related to the mass flow of air through sample, I, and observed pressure drop, $\Delta P$, by the simple equation $Z=I/\Delta P$; where the pressure drop has been corrected for the known viscosity-temperature relationships for air and the mass flow calculated using ideal gas equations.

More particularly, Z is calculated from the measured pressure drop, $\Delta P$ (inches if $H_2O$) sample temperature t (°C.) and selected constant air flowrate F (ml/min) via the equation:

$$Z = \frac{F\,(0.000035t + 0.0176)\,(t + 273)}{100\,\Delta P}$$

In this equation, the terms in the first parenthesis correct for changes in air viscosity with temperature; while those in the second correct for density changes. We have found that the above equation is inappropriate in deriving the permeability for the ashes of the wrappers of the present invention.

Briefly, this is the result of the fact that such ashes exhibit orifice flow behavior, i.e., the flow is not proportional to the pressure drop, but is instead, proportional to the square root of the pressure drop. Additionally, this flow does not depend on gas viscosity. Accordingly, the permeability Z (now specified as $Z_o$) is given by the expression:

$$Z_o = \text{Flow } 100 \sqrt{P/(t°c + 273)}$$

Figure 7:
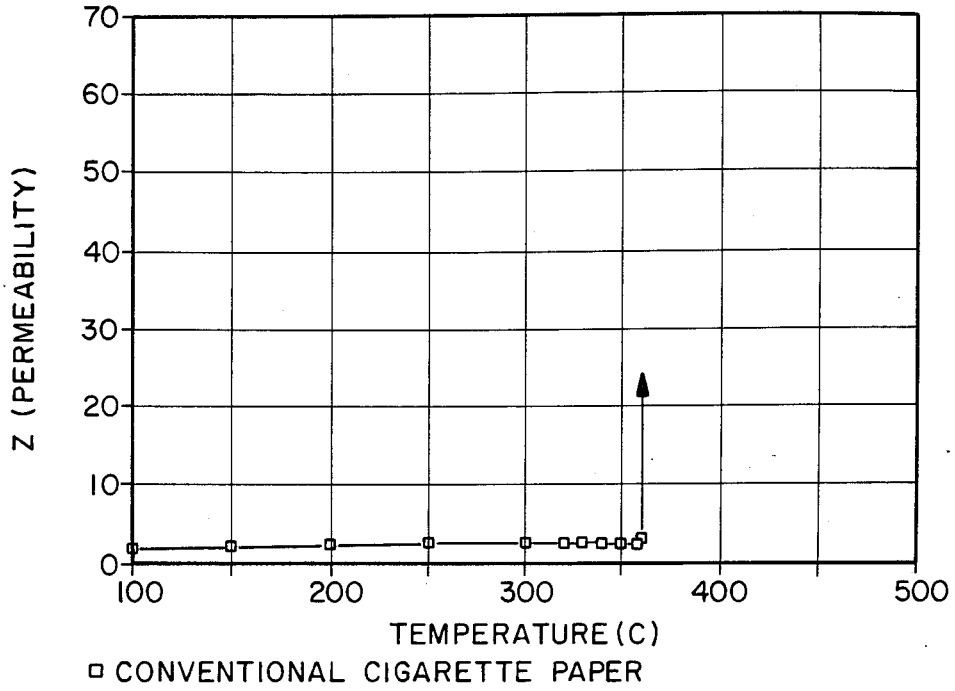
FIG. 7 is a graph illustrating conventional wrapper material of the present invention showing permeability as a function of temperature.
Figure 8:
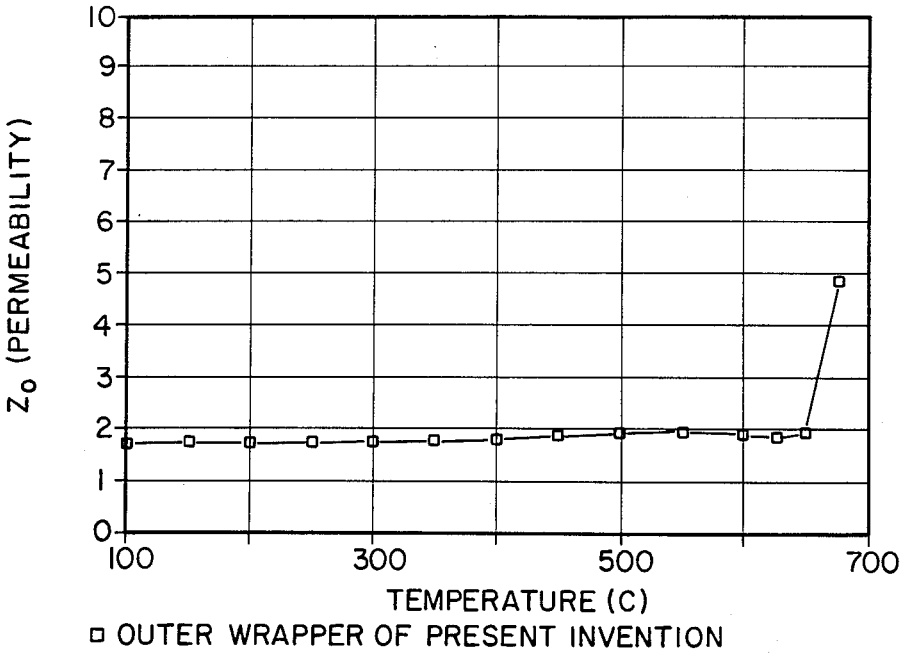
FIG. 8 is a graph of outer wrapper of the present invention showing permeability as a function of temperature.

These permeability-temperature plots are shown in FIGS. 7 and 8. Particularly interesting in these figures is the behavior of conventional cigarette wrappers (FIG. 7) where the wrapper has ruptured at the modest temperature of 350° C. to yield a product with essentially infinite permeability while the outer wrapper of this invention (following burnout) exhibits the rather constant, desired low permeability for throttling purposes over a large temperature range (The abrupt upturn in $Z_o$ at 650° C. is occasioned by the fusion of the glass microfibers.)

Production of both the inner and outer wrappers may be made using conventional papermaking techniques as will be known to those skilled in this art. In general, the sheet components are diluted with water and the slurry applied to a papermaking wire where the water is removed and the sheet dried by passing over and between heated rolls. Other web forming techniques such as airforming may also be used if desired.

The preferred embodiments of the outer wrapper will have a basis weight in the range of from about 35 to 45 gsm, a weight percentage of hydrated bleached kraft pulp in the range of from about 40 to 80, a weight percentage of the high temperature resistant microfibers in the range of from about 10 to 30, a weight percentage of mineral filler in the range of from about 10 to 30 percent (preferably attapulgite clay and titanium dioxide). Finally, it will contain a burn enhancer such as potassium citrate in the range of from about 3 to 10 percent by weight. The attapulgite clay preferably is Attagel TM 40 from Englehart Industries, and the high temperature-resistant fiber is preferably glass microfibers, for example Evans 606.

Other high temperature microfibers that may be employed include Fiberfrax TM (aluminum silicate), silicon carbide, calcium sulfate, and carbon fibers. Certain high temperature resistant organic fibers may also be used such as Nomex TM or Kevlar TM aromatic polyamides as well as PBI (polybenzimidazole) fibers.

The burn enhancer, preferably potassium citrate, serves to provide "biased burning" and contributes to resulting ash strength. After burning the ash may be as low as 20 percent by weight of the initial paper weight without seriously impinging on the coherence, strength and permeability requirements.

Both wrappers must extinguish before the fuel element is completely exhausted and should preferably "go out" after three or four puffs to yield the ash appearance of a newly lit conventional cigarette (5–8 mm in length). This results from biased burning when both wrappers will only free burn if the underlying ceramic fiber jacket is biased appreciably above room temperature by heat transfer from the adjacent burning fuel element. This biasing may be achieved by first providing a low permeability inner sheet (CORESTA permeability of 3–20 and preferably to about 6) and adjusting the bias temperature required for free burning by varying the amount of burn enhancer incorporated in the outer sheet of the wrapper.

EXAMPLES

Table I below lists examples of outer wrapper materials, all of which were treated with 6.5 to 7.0 percent potassium citrate by weight and tested for ash strength. In Table I the ash strengths are ranked on a scale of 0 to 5, where 5 is the strongest, and 0 is the weakest. From the data it can be seen that only Examples 1, 2, 6, 7 and 17 produced in accordance with the invention exhibit the desirable combination of strength and ash color. Furthermore, these particular examples all exhibit ash color and appearance which closely resemble conventional cigarette ashes, especially when small amounts (e.g. 5 to 15% by weight) of $TiO_2$ are incorporated into the furnish.

| | | INORGANIC SHEET COMPONENTS | ASH STRENGTH | |
|---|---|---|---|---|
| 1. | Control | 18% glass<br>8% Attagel 40<br>4% $TiO_2$ | Good | 5 |
| 2. | | 18% glass<br>12% Fumed Alumina | Good | 4 |
| 3. | | 18% glass<br>12% KAOYN Clay (Hydroglass) | Fair | 3 |
| 4. | | 18% glass<br>12% ALBACAR Chalk | Fair to Poor | 2 |
| 5. | | 18% glass<br>12% ANSILEX | Fair to Poor | 2 |
| 6. | | 18% glass<br>12% Calcium Sodium Metaphosphate | Good | 5 |
| 7. | | 18% Calcium Sodium Metaphosphate<br>12% Attagel 40 | Good<br>More Brittle than Control | 4 |
| 8. | | 18% glass<br>12% Calcium Sulfate | Fair to Poor<br>Cracks | 3 |
| 9. | | 12% glass<br>18% Calcium Sulfate | Fair to Poor<br>Cracks | 3 |
| 10. | | 30% Calcium Sulfate | Poor<br>Curls, Cracks | 1 |
| 11. | | 18% Calcium Sulfate<br>12% Fumed Alumina | Poor | 1 |
| 12. | | 18% Calcium Sulfate<br>12% Attagel 40 | Fair to Poor | 2 |
| 13. | | 18% Fumed Alumina<br>8% Attagel 40<br>4% $TiO_2$ | Poor | 1 |
| 14. | | 30 gsm<br>30% Fumed Alumina | No Strength | 0 |
| 15. | | 30 gsm<br>30% $CACO_3$ | No Strength | 0 |
| 16. | | 18% Calcium Sodium Phosphate<br>6% Attagel 40<br>6% Fumed Aluminum | Fair to Poor | 3 |
| 17. | | 18% Calcium Sodium Phosphate<br>12% Attagel | Good | 4 |

Thus it is apparent that there has been provided, in accordance with the invention, wrapper materials that fully satisfy the objections, aims, and advantages set forth above. While the invention has been described in conjunction with the specific embodiments thereof, it is evident that any alternatives, modifications, and variations will be apparent to those skilled in the art in light of the foregoing descriptions. Accordingly, it is intended to embrace all such alternatives, modifications, and variations as followed in the spirit and broad scope of the appended claims.

We claim:

1. In a dual inner and outer sheet wrapper construction for a smoking article including an assembly of components, the improvement wherein said inner sheet encloses said components and contains cellulose fibers and in combination with said outer sheet burns with a permeability transition in excess of 500° C. to produce a high permeability ash and wherein said outer sheet surrounds said inner sheet and comprises 40 to 80 percent cellulose fibers, 10 to 30 percent high temperature resistant microfibers, and 10 to 30 percent mineral filler and wherein said dual wrapper constructiion contains up to about 10 percent of a burn enhancer and burns to produce a desirable ash color.

2. The improved wrapper of claim 1 wherein said mineral filler includes up to 10 percent of titanium dioxide.

3. The improved wrapper of claim 2 wherein said high temperature resistant microfibers are glass microfibers.

4. The improved wrapper of claim 3 wherein said glass microfibers have a diameter generally in the range of from about 0.7 to 5.0 microns.

5. The improved wrapper of claim 4 wherein the burn enhancer is an alkali metal salt and is contained in said outer sheet in an amount between 3 and 10 percent by weight.

6. The improved wrapper of claim 5 wherein said amount of burn enhancer is partially contained in said inner sheet and the remainder is contained in said outer sheet.

7. The improved wrapper of claim 5 wherein the burn enhancer is selected from the group consisting of sodium citrate and potassium citrate.

8. The improved wrapper of claim 7 wherein the amount of titanium dioxide in the outer wrapper is in the range of from about 2 to 8 percent.

9. The improved wrapper of claim 7 wherein the outer wrapper maintains low permeability at temperatures in excess of 400° C. and maintains pressure drop at temperatures in excess of 400° C.

10. The improved wrapper combination of claim 7 further containing a few percent of a reagent selected from solid oxidizers and low melting, nonvolatile Lewis acids.

11. The wrapper construction of claims 2, 3, 4, 5, 6, 7, 8, 9, 10, or 1 wherein said mineral filler comprises attapulgite clay.

* * * * *